United States Patent [19]

Yano et al.

[11] Patent Number: 4,975,314

[45] Date of Patent: Dec. 4, 1990

[54] CERAMIC COATING BONDED TO METAL MEMBER

[75] Inventors: Mitsuru Yano, Okagaki; Norio Takahashi, Omiya; Masatoshi Nakamizo, Kitakyushu; Tomoyuki Kido, Kitakyushu; Masatoshi Kawata, Kitakyushu; Katsumi Morikawa, Ashiya, all of Japan

[73] Assignee: Hitachi Metals, Ltd., Tokyo, Japan

[21] Appl. No.: 236,389

[22] Filed: Aug. 25, 1988

[30] Foreign Application Priority Data

Aug. 26, 1987 [JP] Japan ..... 62-212120
Jul. 13, 1988 [JP] Japan ..... 63-174169

[51] Int. Cl.[5] ..... B32B 7/02

[52] U.S. Cl. ..... 428/213; 428/212; 428/323; 428/324; 428/325; 428/330; 428/402; 428/426; 428/428; 428/432; 428/450; 428/472; 428/688; 428/699

[58] Field of Search ..... 428/426, 428, 432, 406, 428/403, 402, 323, 325, 324, 330, 212, 213, 450, 472, 688, 699

[56] References Cited

U.S. PATENT DOCUMENTS

| | | | |
|---|---|---|---|
| 4,276,331 | 6/1981 | Bothwell | 428/34.6 |
| 4,277,539 | 7/1981 | Keller et al. | 428/450 |
| 4,485,150 | 11/1984 | Tsuno | 428/472 |
| 4,680,239 | 7/1987 | Yano et al. | 428/215 |
| 4,746,568 | 5/1988 | Matsumoto et al. | 428/323 |

FOREIGN PATENT DOCUMENTS

| | | |
|---|---|---|
| 58-51214 | 3/1983 | Japan . |
| 58-99180 | 6/1983 | Japan . |
| 59-12116 | 1/1984 | Japan . |

*Primary Examiner*—Ellis P. Robinson
*Assistant Examiner*—Archene Turner
*Attorney, Agent, or Firm*—Finnegan, Henderson, Farabow, Garrett & Dunner

[57] ABSTRACT

A ceramic coating bonded to a metal member comprising a bonding layer formed by the reaction of an oxide layer formed on a surface of said metal member in advance and a silicated; and an anti-oxidizing first ceramic layer formed on said bonding layer and comprising inorganic flaky particles burned to have a cross-linked laminate structure.

11 Claims, 6 Drawing Sheets

CERAMIC COATING BONDED TO METAL MEMBER

BACKGROUND OF THE INVENTION

The present invention relates to a ceramic coating bonded to a metal member for use in exhaust equipment of internal combustion engines, etc. and a method of producing it.

For metal members such as exhaust equipment of internal combustion engines, etc., which are exposed to corrosive gases at high temperature and severe heat shock, it was proposed to form ceramic linings on the inner surfaces of such metal members to impart a heat resistance, a corrosion resistance and a heat shock resistance.

Significant problems with such ceramic coatings are that since they are subjected to severe heat shock by a high-temperature exhaust gas, a large stress is generated on the boundaries between the ceramic coatings and the metal members due to the difference in thermal expansion between them, leading to the peeling of the ceramic coatings from the metal members. Also since the ceramic coatings have much smaller heat conductivity than the metal, an extremely large temperature gradient appears in the ceramic coatings, thereby generating a large stress in the ceramic coatings, which leads to the peeling and cracking of the ceramic coatings.

In general, although ceramics have large compression strength, they have little tensile strength and are extremely brittle. Accordingly, they are extremely less resilient to thermal shock.

To solve these problems, various proposals were made.

For instance, Japanese Patent Laid-Open No. 58-51214 discloses exhaust gas equipment for internal combustion engines comprising a metal equipment body to be exposed to a high-temperature exhaust gas, an inner surface of which is coated with a refractory layer composed of a mixture of refractory material particles and a heat-resistant inorganic binder.

In addition, as a method of forming a ceramic layer by attaching ceramic particles after applying an inorganic binder to an inner surface of a metal member, Japanese Patent Laid-Open No. 58-99180 discloses a method of producing exhaust gas equipment for internal combustion engines which comprises the steps of forming a heat-resistant layer by coating an inner surface of a metal equipment body to be exposed to a high-temperature exhaust gas with a slip composed of a mixture of refractory material particles, an inorganic binder and frit; forming a refractory, heat-insulating layer by coating the heat-resistant layer while it is in a wet state, with refractory, heat-insulating particles; and then, after solidifying the heat-insulating layer, forming a heat-resistant layer thereon by coating the refractory, heat-insulating layer with a slip composed of a mixture of refractory material particles, an inorganic binder and a frit. If necessary, the heat-resistant layer can be coated with a further refractory, heat-insulating layer, and a further heat-resistant layer repeatedly to produce a ceramic coating.

However, these methods fail to provide sufficient bonding strength between the ceramic layer and the metal, leaving the problem that ceramic layers are likely to peel off from the metal members along the bonding boundaries or in the ceramic layers themselves by heat shock. Thus, they are not satisfactory in durability for a long period of time.

Recently, ceramic paints and coating materials containing metal alkoxides as binders were developed. However, these materials are extremely expensive, and it is difficult to coat them in sufficient thickness to enable them to endure use for a long period of time.

Further, Japanese Patent Laid-Open No. 59-12116 discloses a composite ceramic material comprising inorganic hollow particles dispersed in a ceramic matrix. However, mere dispersion of inorganic hollow particles in a matrix fails to provide a coating having good bonding strength to a metal surface and high heat shock resistance, though it has sufficient heat resistance. In addition, since the inorganic hollow particles have small strength, they are easily broken, leading to peeling and cracking of the resulting ceramic coating.

Next, it has been found that when a ceramic coating bonded to a metal member is exposed to a corrosive exhaust gas, etc. at high temperature for a long period of time, the corrosive exhaust gas penetrates into the ceramic layer and reaches to the boundary with the metal, thereby oxidizing the metal surface. The oxidation of the metal surface leads to extreme decrease in bonding strength between the ceramic layer and the metal layer, which means that the ceramic layer is easily peeled off by mechanical shock or heat shock.

OBJECT AND SUMMARY OF THE INVENTION

An object of the present invention is, therefore, to provide a ceramic coating bonded to a metal member having a sufficient bonding strength and good anti-oxidation property, whereby there occurs no peeling off in use at high temperature for a long period of time.

Another object of the present invention is to provide a method of producing such a ceramic coating bonded to a metal member.

As a result of intense research in view of above objects, the inventors have found that a ceramic coating, which is not likely to peel off from a metal member even when it is exposed to high-temperature, corrosive exhaust gas for a long period of time, can be obtained by forming a bonding layer generated by a reaction between an oxide layer of the metal and a silicate and an anti-oxidizing first ceramic layer composed of burned inorganic flaky particles, and further, if necessary, a second and/or third ceramic layer to impart heat insulation and heat resistance to the ceramic coating. The present invention is based on this finding.

Thus, the ceramic coating bonded to a metal member according to the present invention comprises a bonding layer formed by the reaction of an oxide layer formed on a surface of said metal member in advance and a silicate; and an anti-oxidizing first ceramic layer formed on said bonding layer and comprising inorganic flaky particles burned to have a cross-linked laminate structure.

Further, the method of producing a ceramic coating on a metal member according to the present invention comprises the steps of:

(a) forming an oxide layer on a surface of said metal member by an oxidation treatment;

(b) coating said oxide layer with a silicate binder to form a layer which is to be converted to a bonding layer by a subsequent burning treatment;

(c) coating said layer with a mixture of inorganic flaky particles, a silicate binder and a hardener to form an anti-oxidizing first ceramic layer; and (d) after curing and drying, burning the resulting ceramic coating in an atmosphere having an oxygen partial pressure of 10 mmHg or less, thereby burning said first ceramic layer and causing a reaction between said oxide layer and said silicate to form said bonding layer.

DETAILED DESCRIPTION OF THE INVENTION

Figure 1A:
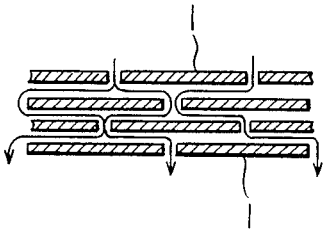
FIG. 1(*a*) is a schematic view showing the function of flaky particles in the anti-oxidizing layer according to the present invention in comparison with spherical particles -FIG. 1(*b*)

The ceramic coating bonded to a metal member according to the present invention comprises as indispensable layers a bonding layer and an anti-oxidizing first ceramic layer, and, if necessary, further comprises a heat-insulating second ceramic layer, a refractory third ceramic layer and a surface layer. Each layer will be described in detail below.

(1) Bonding Layer

To strongly bond ceramic to a metal surface, it is important that the ceramic is bonded to the metal surface by the synergistic action between physical adhesion and chemical bonding. The inventors have found through research that the formation of an oxide layer on the metal surface in advance is effective in achieving strong bonding therebetween.

By forming an oxide layer on the metal surface in advance, the metal surface becomes finely rough. As a result, its wettability by a silicate solution as a binder is improved. Further, since the oxide layer and the silicate are reacted by a heat treatment, they are chemically strongly bonded to form a good bonding layer.

The bonding layer serves not only to bond the anti-oxidizing layer and the metal but also to prevent the penetration of a corrosive gas to the metal surface from outside. The bonding layer properly has a thickness of 50 μm or less. If it exceeds 50 μm, the bonding layer is likely to peel off. The preferred thickness of the bonding layer is 2–30 μm. The term "thickness" used herein means an average thickness, and it should be noted that it may vary by 20–30% or so in the entire bonding layer.

Incidentally, in the case of a porcelain enamel, a ceramic layer is formed on a metal surface free from an oxide layer, and it is then burned and oxidized to form an oxide on the metal surface, thereby achieving a strong bonding of the ceramic to the metal. On the other hand, in the present invention, the metal surface is provided with an oxide layer in a predetermined thickness in advance, and after applying a silicate binder, it is burned in a neutral atmosphere to cause a reaction between the oxide layer and the silicate, thereby forming a stable bonding layer. Incidentally, in the present invention, if a sufficient bonding layer is formed, the oxide layer may remain to some extent without changing the effects of the present invention.

In the present invention, the formation of the oxide layer on the metal surface can be conducted by placing the metal member in an heated atmosphere. As a heated atmosphere, steam at 500° C. or more is preferable.

The reaction of the oxide layer with the silicate can be conducted in the final heat treatment process; that is, it can be conducted at a final stage in a neutral atmosphere at about 750°–850° C. for about 0.5–1.5 hours. As a neutral atmosphere, an atmosphere having oxygen partial pressure of 10 mmHg or less can be used.

The silicates which can be used in the present invention include sodium silicate, potassium silicate and lithium silicate, and they may be used alone or in combination. The silicate is used in a sol state. These silicates have thermal expansion coefficients successively increasing in the order of lithium silicate, potassium silicate and sodium silicate. Thus, by properly selecting these silicates, the thermal expansion coefficient of the bonding layer can be fitted to that of the metal.

(2) First Ceramic Layer (Anti-Oxidizing Layer)

Ceramics generally have a bending strength which is nearly ⅓ to 1/10 of their compression strength, and smaller ductility and elongation than metals. In addition, they are extremely brittle. Therefore, high-temperature thermal shock causes strain in the ceramics, leading to their breakage.

The inventors have found through research that an anti-oxidizing layer having a structure in which inorganic flaky particles are laminated and cross-linked is effective to eliminate these problems.

The inorganic flaky particles which can be used herein include those produced by crushing natural mica, artificially synthesized mica, thin-film glass, inorganic hollow particles such as microballoons, etc. The inorganic flaky particles may have a longer diameter and a shorter diameter each within 2–74 μm or so and a thickness of 0.1–3 μm or so, their longer diameter/thickness ratio being 10 or more. More preferably, their longer diameter is 5–30 μm, their thickness 0.5–2 μm, and their ratio of longer diameter to thickness 15 or more. When the longer diameter is greater than 74 μm, their fluidity becomes low as a coating material, and the surface of the resulting coating becomes rough. When it is less than 2 μm, the particles become close to spheres, losing their advantages as flakes.

The anti-oxidizing layer can be formed by mixing the inorganic flaky particles with a silicate binder and a hardener, applying the mixture to the bonding layer and then curing, drying and burning it. The silicate binder may be the same as used for the bonding layer, and the hardener may be burned aluminum phosphate, calcium silicate, etc.

The proportion of the inorganic flaky particles in the anti-oxidizing layer may be generally 30–60 weight % or so, and preferably 40–50 weight %.

According to the method of the present invention, a mixture of the inorganic flaky particles, the silicate binder and the hardener is applied onto the bonding layer in a slip state. After applying, it is cured at 18°–30° C. or so for 8–24 hours. It is then dried to remove water sufficiently, and then it is burned at 750°–800° C. for 0.5–1.5 hours. The burning of the anti-oxidizing layer may be conducted in a neutral atmosphere having an oxygen partial pressure of 10 mmHg or less.

In the anti-oxidizing layer thus produced, the inorganic flaky particles exist in a laminated state because of their flat shape, and linked to each other by consolidation.

If the flaky particles have the same weight as sphere or cobble-shaped particles generally used, the flaky particles have a much larger surface area, which leads to a larger bonding area when laminated, thereby significantly increasing a bonding strength between the particles in the layer.

Figure 1B:
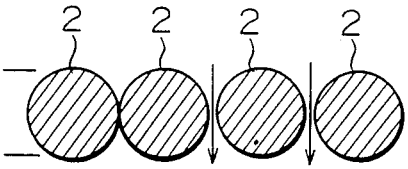

To show this mechanism schematically, comparison between flaky particles and sphere particles having the same material and weight is shown in FIG. 1. FIG. 1(*a*) is a schematic view showing the flaky particles in a laminated state, and FIG. 1(*b*) is a schematic view showing the sphere particles aligned in a line.

The weight of a flaky particle 1 of 15 μm in length, 15 μm in width and 1 μm in thickness is equivalant to that of a sphere 2 having a diameter of 7.5 μm, and an area of metal surface covered by a single flaky particle corresponds to that of four sphere particles. This means that in terms of lamination efficiency, one flaky particle corresponds to 4 sphere particles. Because of large contact area between the flaky particles, a bonding strength between the flaky particles when laminated is extremely large. At the same time, the distance of a path through which a corrosive gas must penetrate to and reach the metal surface is extremely long, must inhibiting the corrosion of the metal.

The structure in which flaky particles are laminated and cross-linked is highly flexible and subjected to less cracking and peeling than the structure made by the spherical particles. Even if a crack generates in a laminate layer, its propagation is extremely slow because of laminated structure.

With respect to the anti-oxidizing layer, the thicker the better from the viewpoint of corrosion resistance. However, when it exceeds 1000 μm, the anti-oxidizing layer is likely to peel off by high-temperature heat shock. On the other hand, when it is less than 150 μm, a sufficient corrosion resistance cannot be achieved. The preferred thickness of the anti-oxidizing layer is 300–700 μm.

Incidentally, to prevent the peeling of the anti-oxidizing layer, its thermal expansion coefficient is desirably as close to that of the metal as possible. Specifically, the difference in a thermal expansion coefficient between them may be up to 0.3% or so, and preferably 0–0.1%. For this purpose, it is necessary to adjust the composition of ceramic components in the anti-oxidizing layer.

Generally, ceramics have a much smaller thermal expansion coefficient than the metals, but the thermal expansion coefficient of the ceramic layer can be made closer to that of the metal member by increasing the amounts of $K_2O$, $Na_2O$ in the ceramic matrix and making it glassy.

The matrix of the ceramic layer is constituted by a silicate, and usable as a silicate is one or more of sodium silicate, potassium silicate and lithium silicate in a sol state. Among these silicates, lithium silicate, potassium silicate and sodium silicate have successively increasing thermal expansion coefficients, and the increase of the alkali content leads to a larger thermal expansion coefficient. Accordingly, by selecting these components, the thermal expansion coefficient of the first ceramic layer can be fitted to that of the metal.

(3) Second Ceramic Layer (Heat-Insulating Layer)

This layer is to impart heat insulation to the ceramic coating, and it has a structure composed of a burned heat-insulating material mainly composed of inorganic hollow particles or microballoons. It may be formed by applying a mixture of a heat-insulating material, a silicate binder and a hardener onto the dried first ceramic layer, curing and drying, and then burning it in a neutral atmosphere having an oxygen partial pressure of 10 mmHg or less.

The heat-insulating materials which can be used herein include inorganic hollow particles such as Silasu (volcanic glass) balloons, foamed silica, ceramic microballoons, etc. These particles generally have an average particle size of 10–500 μm. When it is less than 10 μm, cracking and peeling due to shrinkage take place, and when it is larger than 500 μm, a flat and smooth layer cannot be easily formed. The preferred particle size of the inorganic particles is 40–200 μm.

Figure 11:
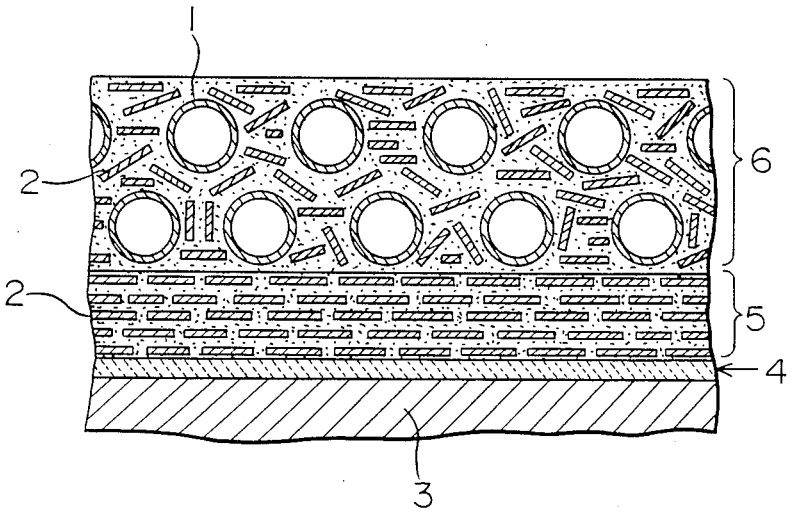

With respect to the silicate binder and the hardener, they may be the same as those used for the anti-oxidizing layer. And the curing, drying and burning conditions may be the same as in the formation of the anti-oxidizing layer. Incidentally, the heat-insulating layer may contain inorganic flaky particles as shown in FIG. 11. When it has a structure in which inorganic flaky particles are contained, the heat-insulating layer has sufficient strength and flexibility, meaning that its peeling and cracking does not take place readily by high-temperature heat shock, and that it has an improved resistance to oxidation.

With respect to the heat-insulating layer, the thicker the better from the viewpoint of heat insulation. However, when it exceeds 2000 μm, peeling is likely to take place by high-temperature heat shock, and when it is less than 200 μm, a heat-insulating effect cannot be obtained. The preferred thickness of the heat-insulating layer is 300–800 μm.

(4) Third Ceramic Layer (Refractory Layer)

This layer is formed to impart heat resistance to the ceramic coating, and it has a structure produced by burning a refractory material based on inorganic particles.

The refractory layer can be formed by applying a mixture of a refractory material, a silicate binder and a hardener onto the dried heat-insulating layer, curing and drying, and then burning it in a neutral atmosphere having an oxygen partial pressure of 10 mmHg or less.

The refractory materials which can be used herein include chamotte, alumina, zircon, zirconia and any other refractory materials which are generally used. Among them, zirconia is preferable because it has a low thermal conductivity. The refractory material powder has generally an average particle size of 10–500 μm. When it is smaller than 10 μm, agglomeration of refractory particles is likely to take place, making it difficult to form a flat layer and also making it likely that it will shrink under the influence of high temperature. On the other hand, when it is larger than 500 μm, a flat layer is difficult to form. The preferred average particle size of the refractory powder is 20–200 μm.

Incidentally, the silicate binder and the hardener may be the same as used for the anti-oxidizing layer.

With respect to the conditions of curing, drying and burning to form the refractory layer, they may be essentially the same as in the formation of the anti-oxidizing layer.

With respect to a thickness of this layer, the larger the better from the viewpoint of heat resistance, but when it exceeds 2000 μm, it is likely to peel off by high-temperature heat shock. And when it is less than 100 μm, a sufficient refractory effect cannot be obtained. The preferred thickness of the refractory layer is 200–800 μm.

(5) Surface Layer

This layer is a thin, dense ceramic layer formed on the dried surface of the anti-oxidizing layer, the heat-insulating layer or the refractory layer for preventing corrosive gas to penetrating from the metal surface.

The surface layer is composed of an inorganic binder and/or an organometallic binder, and it may be formed by applying the inorganic binder and/or the organometallic binder to the dried surface of the anti-oxidizing layer, the heat-insulating layer or the refractory layer and then burning it in an atmosphere having an oxygen partial pressure of 10 mmHg or less.

If the inorganic binder and/or the organometallic binder can be stabilized only by drying, the surface layer can be formed only by applying the inorganic binder and/or the organometallic binder onto the dried surface of the anti-oxidizing layer, the heat-insulating layer or the refractory layer after burning, and then drying.

The inorganic binders which can be used include sols of alkali silicates such as sodium silicate, potassium silicate and lithium silicate, a silica sol, alumina sol, an aluminum phosphate solution, etc.

The organometallic binders which can be used may be those containing, as main components, silicon alkoxide, zirconium alkoxide, etc.

It is difficult to fit the thermal expansion coefficient of this layer to that of a metal material. Therefore, it is necessary that the surface layer has a thickness of 15 μm or less. When it exceeds 15 μm, a large stress exists in the surface layer because of the difference in thermal expansion coefficient between the surface layer and the metal, making it likely that it will be peeled off and cracked. The preferred thickness of the surface layer is 3–10 μm.

The bonding layer, the first ceramic layer (anti-oxidizing layer , the second ceramic layer (heat-insulating layer) , the third ceramic layer (refractory layer) and the surface layer are explained above, but it should be noted that all of these layers need not exist except for the bonding layer and the anti-oxidizing layer. Accordingly, the preferred combinations of ceramic layers according to the present invention are as follows:

(a) Bonding layer+anti-oxidizing layer (b) Bonding layer+anti-oxidizing layer+surface layer (c) Bonding layer+anti-oxidizing layer+heat-insulating layer (d) Bonding layer+anti-oxidizing layer+heat-insulating layer+surface layer (e) Bonding layer+anti-oxidizing layer+refractory layer (f) Bonding layer+anti-oxidizing layer+refractory layer+surface layer (g) Bonding layer+anti-oxidizing layer+heat-insulating layer+refractory layer (h) Bonding layer+anti-oxidizing layer+heat-insulating layer+refractory layer+surface layer The present invention will be described in detail referring to the following Examples.

EXAMPLE 1

Figure 4:
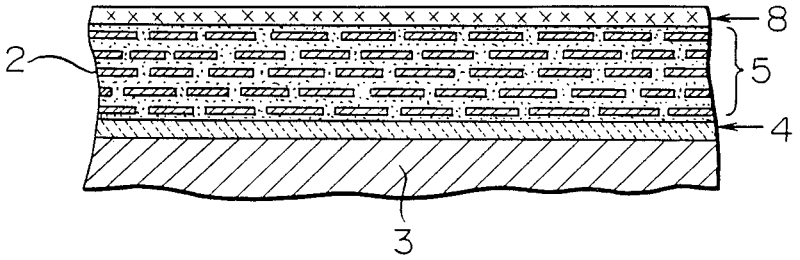

FIG. 4 is a view schematically showing the cross section of a ceramic coating consisting of a bonding layer 4, a first ceramic layer 5 and a surface layer 8.

Figure 2:
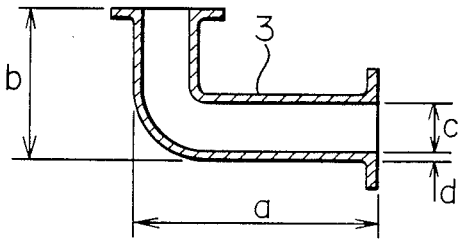
FIG. 2 is a cross-sectional view showing one example of a metal member to which the present invention is applicable.

An L-shaped tubular member 3 made of vermicular cast iron and having a shape as shown in FIG. 2 (long arm a: 200 mm, short arm b: 120 mm, inner diameter c: 40 mm, thickness d: 3 mm) was placed in a furnace having a heated steam atmosphere controlled at 550° C. for 90 minutes to form an oxide layer on its inner and outer surfaces.

To form a bonding layer, this tubular member 3 was immersed in a potassium silicate solution ($SiO_2/K_2O$ molar ratio 3.0, concentration 10 weight %) for 3 minutes and then excess potassium silicate was removed. Thereafter, it was heated from room temperature to 150° C. over 25 minutes in a drying device and kept at 150° C. for 1 hour and then cooled to room temperature.

Next, to form a first ceramic layer, inorganic flaky particles consisting of crushed Sirasu balloons, a silicate binder and a hardener as shown below were mixed in the following ratio to form a slurry.

Sodium silicate ($SiO_2/Na_2O$ molar ratio 3.0, concentration 30 weight %)
100 parts by weight
Crushed Sirasu balloons (<74 μm)
30 parts by weight
Burned aluminum phosphate (<74 μm)
10 parts by weight This mixture slurry was applied to the inner and outer surfaces of the tubular member 3, cured for 2 hours and then applied again to form a two-layer laminate as a first ceramic layer (anti-oxidizing layer) 5.

In this state, it was cured at room temperature for 15 hours to cause a hardening reaction of sodium silicate and burned aluminum phosphate.

Next, this tubular member 3 was heated from room temperature to 300° C. at a heating rate of 1° C./minute in a drying device, kept at 300° C. for 1 hour and then cooled to room temperature to remove excess water.

Next, this tubular member 3 was heated to 800° C. at a heating rate of 200° C./hr in an $N_2$ atmosphere (oxygen partial pressure: 5 mmHg) in a furnace , kept at 800° C. for 1 hour and then cooled to room temperature without being taken out of the furnace, thereby burning and hardening the bonding layer 4 and the first ceramic layer 5.

Further, a silica sol was applied to the first ceramic layer 5 formed on the inner and outer surfaces of the tubular member 3, and the tubular member 3 was heated to 110° C. at a heating rate of 10° C./minute, kept at 110° C. for 1 hour and then cooled to room temperature to form a surface layer 8 having a thickness of 8 μm.

The ceramic layer-coated tubular member 3 thus produced had the bonding layer 4 of about 10 μm in thickness formed on the surface of the tubular member 3, and the surface of this bonding layer 4 was covered by the first ceramic layer 5 having a thickness of about 300 μm in which flaky particles of 0.5–2 μm in thickness and 5–20 μm in length were laminated in a cross-linked manner, and the surface of the first ceramic layer 5 was covered by the thin, dense surface layer 8 having a thickness of about 8 μm.

To evaluate the properties of this ceramic coating, the following tests were conducted.

(1) Test for Measuring Weight Gain by Oxidation

The above tubular member 3 was attached to an apparatus which generated a high-temperature gas by burning propane gas to heat an inner surface of the tubular member 3. The test was conducted under the following conditions:

| | |
|---|---|
| Gas temperature | 980° C. |
| Primary air flow | 50 $Nm^3/hr$ |
| Propane gas flow | 2 $Nm^3/hr$ |
| Secondary air flow | 36 $Nm^3/hr$ |
| Oxygen concentration | 11% |
| Temperature of inner surface of tubular member | 620° C. (coated) |
| Temperature of inner surface of tubular member | 580° C. (uncoated) |
| Weight before test | 1390.91 g (coated) |
| Weight before test | 1352.24 g (uncoated) |

The weight gains by oxidation are shown in Table 1. Table 1 also shows, for comparison, the weight gains by oxidation in the case of no ceramic coating.

TABLE 1

| Test Time (hr) | Weight Gain by Oxidation (g) | |
|---|---|---|
| | Uncoated | Coated |
| 10 | 1.56 | 0.06 |
| 25 | 3.48 | 0.54 |
| 40 | 4.19 | 0.31 |
| 54 | 5.10 | 1.17 |
| 70 | 6.05 | 1.42 |

It is shown in Table 1 that the weight gain by oxidation in the ceramic coated member is about ¼ as much as in the uncoated member.

(2) Durability Test

The tubular member 3 was subjected to 100 cycles of heating and cooling repeatedly in the heating evaluation apparatus.

The conditions of heating and cooling were as follows:

| | |
|---|---|
| Gas temperature | 1050° C. |
| Primary air flow | 300 $Nm^3/hr$ |
| Propane gas flow | 12 $Nm^3/hr$ |
| Secondary air flow | 200 $Nm^3/hr$ |
| Oxygen concentration | 15% |
| Temperature of outer surface of tubular member | 780° C. (coated) |
| Heating rate | 1000° C./min |
| Heating time | 30 min |
| Cooling in the air | 30 min |

As a result of the above test, the ceramic coating suffered from no cracking and peeling at all, confirming that it had sufficient durability.

Although the tubular member was coated with a ceramic layer on its inner and outer surfaces in this Example, it is of course possible to coat only the inner surface of the tubular member with a ceramic layer.

EXAMPLE 2

Figure 3:
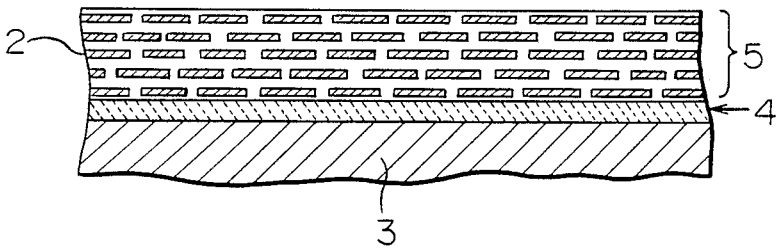
FIGS. 3–11 are cross-sectional views schematically showing the ceramic coating bonded to a metal member in each Example.

FIG. 3 is a cross-sectional view schematically showing a ceramic coating consisting of a bonding layer 4 formed on the inner surface of the metal tubular member 3 and an anti-oxidizing layer 5.

The metal tubular member 3 made of cast iron was heated at 550° C. to form an oxide layer having a thickness of 3 μm.

To form a bonding layer, this tubular member 3 was immersed in a potassium silicate solution ($SiO_2/K_2O$ molar ratio 3.0, concentration 23 weight %) for 3 minutes and then excess potassium silicate solution was removed. Thereafter, it was heated from room temperature to 150° C. over 25 minutes in a drying device and kept at 150° C. for 1 hour and then cooled to room temperature, thereby forming the bonding layer 4.

Next, to form the first ceramic layer, inorganic flaky particles 1 (crushed particles of thin glass consisting essentially of 77 weight % $SiO_2$, 14 weight % $Al_2O_3$, 3.3 weight % $Na_2O$ and 3.5 weight % $K_2O$) , sodium silicate (a silicate binder) and burned aluminum phosphate (a hardener) were mixed in the following ratio to form a mixture slurry.

Sodium silicate ($SiO_2/Na_2O$ molar ratio 3.0, concentration 30 weight %)
100 parts by weight
Crushed particles of thin glass (<74 μm)
30 parts by weight
Burned aluminum phosphate (<74 μm)
10 parts by weight The above mixture slurry was applied to the inner surface of the metal tubular member 3, cured for 1 hour and then applied again to form an anti-oxidizing layer 5 having a thickness of 300 μm.

In this state, it was cured at room temperature for 15 hours to cause a hardening reaction of sodium silicate and burned aluminum phosphate in the anti-oxidizing layer.

Next, this metal tubular member 3 was heated from room temperature to 300° C. at a heating rate of 1° C./minute in a drying device, kept at 300° C. for 1 hour and then cooled to room temperature to remove excess water. It was then burned as in Example 1.

EXAMPLE 3

FIG. 4 is a cross-sectional view schematically showing a ceramic coating consisting of a bonding layer 4 formed on the inner surface of the metal tubular member 3, an anti-oxidizing layer 5 and a surface layer 8. The bonding layer 4 and the anti-oxidizing layer 5 were formed in the same manner as in Example 2 and dried. After that, a silica sol (concentration 40 weight %) was applied to a surface of the anti-oxidizing layer 5, and heated to 800° C. at a heating rate of 200° C./hr in an $N_2$ atmosphere (oxygen partial pressure: 5 mmHg) , kept at 800° C. for 1 hour and then cooled to room temperature to form the surface layer 8 of 8 μm in thickness.

EXAMPLE 4

Figure 5:
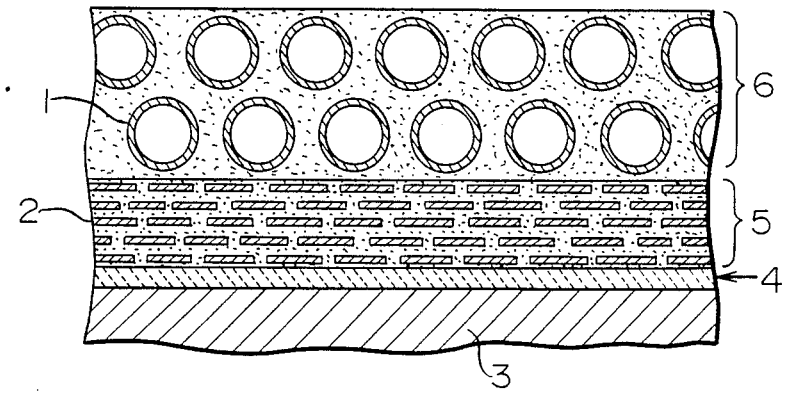

FIG. 5 is a cross-sectional view schematically showing a ceramic coating consisting of a bonding layer 4 formed on the inner surface of the metal tubular member 3, an anti-oxidizing layer 5 and a heat-insulating layer 6.

The metal tubular member 3 made of cast iron was heated at 550° C. to form an oxide layer having a thickness of 3 μm.

This tubular member 3 was immersed in a sodium silicate solution ($SiO_2/Na_2O$ molar ratio 3.0, concentration 23 weight %) for 3 minutes and then excess sodium silicate was removed. Thereafter, it was heated from room temperature to 150° C. over 25 minutes in a drying device and kept at 150° C. for 1 hour and then cooled to room temperature, thereby forming the bonding layer 4.

Next, inorganic flaky particles 1 (crushed particles of thin glass consisting essentially of 77 weight % $SiO_2$, 14 weight % $Al_2O_3$, 3.3 weight % $Na_2O$ and 3.5 weight % $K_2O$) , sodium silicate (a silicate binder) and burned aluminum phosphate (a hardener) were mixed in the following ratio to form a mixture slurry.

Sodium silicate ($SiO_2/Na_2O$ molar ratio 3.0, concentration 30 weight %)
100 parts by weight
Crushed particles of thin glass (<74 μm)
10 parts by weight
Burned aluminum phosphate (<74 μm)
10 parts by weight The above mixture slurry was applied to the inner surface of the metal tubular member 3, cured for 1 hour and then applied again to form an anti-oxidizing layer 5 having a thickness of 300 μm.

In this state, it was cured at room temperature for 15 hours to cause a hardening reaction of sodium silicate and burned aluminum phosphate in the anti-oxidizing layer.

Next, this metal tubular member 3 was heated from room temperature to 300° C. at a heating rate of 1° C./minute in a drying device, kept at 300° C. for 1 hour and then cooled to room temperature to remove excess water.

Next, heat-insulating material powder (Sirasu balloon having a bulk density of 0.2 and a particle size of 44–150 μm), sodium silicate (a silicate binder) and burned aluminum phosphate (a hardener) were mixed in the following ratio to form a mixture slurry.

Sodium silicate ($SiO_2/Na_2O$ molar ratio 3.0, concentration 30 weight %)
100 parts by weight
Sirasu balloon (<74 μm)
30 parts by weight
Burned aluminum phosphate (<74 μm)
10 parts by weight The above mixture slurry was applied to the dried anti-oxidizing layer 5 formed on the inner surface of the tubular member 3 and cured for 2 hour, and this cycle was repeated to form a heat-insulating layer 6.

In this state, it was cured at room temperature for 15 hours to cause a hardening reaction of sodium silicate and burned aluminum phosphate in the heat-insulating layer.

Next, this metal tubular member 3 was heated from room temperature to 300° C. at a heating rate of 1° C./minute in a drying device, kept at 300° C. for 1 hour and then cooled to room temperature to remove excess water.

Next, this metal tubular member 3 was heated to 800° C. at a heating rate of 200° C./hr in an $N_2$ atmosphere (oxygen partial pressure: 5 mmHg), kept at 800° C. for 1 hour and then cooled to room temperature, thereby hardening the heat-insulating layer 6 having a thickness of 1500 μm.

EXAMPLE 5

Figure 6:
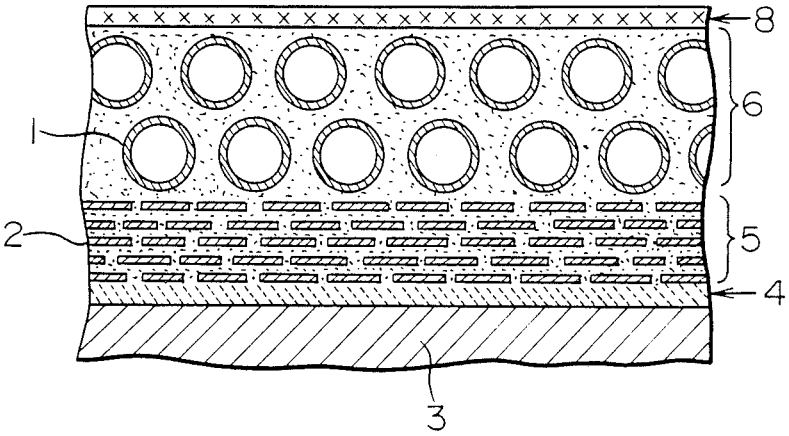

FIG. 6 is a cross-sectional view schematically showing a ceramic coating consisting of a bonding layer 4 formed on the inner surface of the metal tubular member 3, an anti-oxidizing layer 5, a heat-insulating layer 6 and a surface layer 8.

The bonding layer 4, the anti-oxidizing layer 5 and the heat-insulating layer 6 were formed and burned in the same manner as in Example 4. After that, an aluminum phosphate solution (concentration 40 weight %) was applied to a surface of the heat-insulating layer 6, and heated to 110° C. at a heating rate of 10° C./min and kept at 110° C. for 1 hour and then cooled to room temperature to form the surface layer 8 of 8 μm in thickness.

EXAMPLE 6

Figure 7:
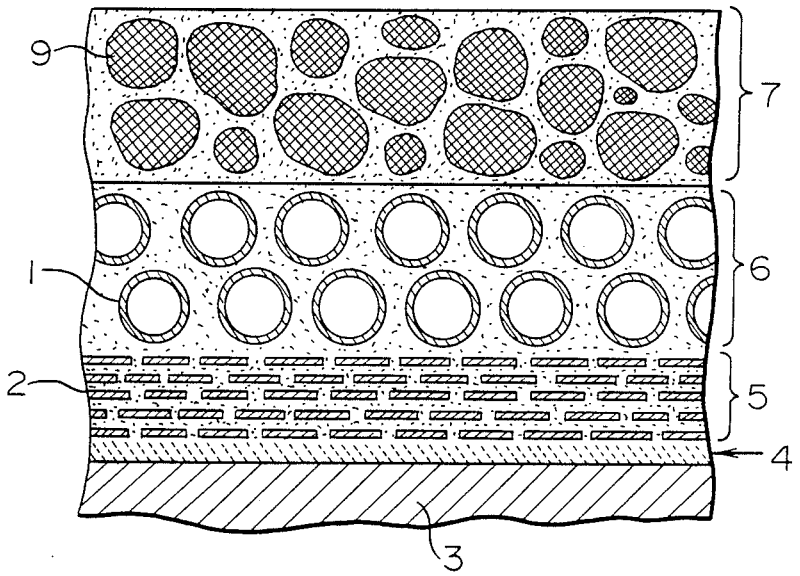

FIG. 7 is a cross-sectional view schematically showing a ceramic coating consisting of a bonding layer 4 formed on the inner surface of the metal tubular member 3, an anti-oxidizing layer 5, a heat-insulating layer 6 and a refractory layer 7.

The bonding layer 4, the anti-oxidizing layer 5 and the heat-insulating layer 6 were formed in the same manner as in Example 4. After that, refractory material powder (stabilized zirconia having a particle size of 44–150 μm), sodium silicate (a silicate binder) and burned aluminum phosphate (a hardener) were mixed in the following ratio to form a mixture slurry.

Sodium silicate ($SiO_2/Na_2O$ molar ratio 3.0, concentration 30 weight %)
100 parts by weight
Stabilized zirconia (<74 μm)
120 parts by weight
Burned aluminum phosphate (<74 μm)
10 parts by weight This mixture slurry was applied to the dried surface of the heat-insulating layer 6 formed on the inner surface of the metal tubular member 3 and cured for 2 hours, and this cycle was repeated to form a refractory layer 7.

In this state, it was cured at room temperature for 15 hours to cause a hardening reaction of sodium silicate and burned aluminum phosphate to take place in the refractory layer.

Next, this metal tubular member 3 was heated from room temperature to 300° C. at a heating rate of 1° C./min in a drying device, kept at 300° C. for 1 hour and then cooled to room temperature to remove excess water.

Next, this metal tubular member 3 was heated to 800° C. at a heating rate of 200° C./hr in an $N_2$ atmosphere (oxygen partial pressure: 5 mmHg), kept at 800° C. for 1 hour and then cooled to room temperature, thereby hardening the refractory layer 7 and the heat-insulating layer 6.

EXAMPLE 7

Figure 8:
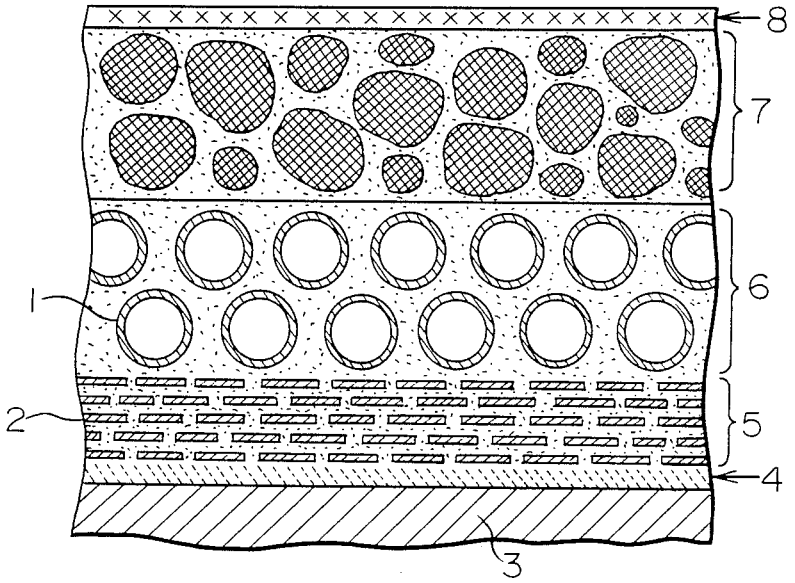

FIG. 8 is a cross-sectional view schematically showing a ceramic coating consisting of a bonding layer 4 formed on the inner surface of the metal tubular member 3, an anti-oxidizing layer 5, a heat-insulating layer 6, a refractory layer 7 and a surface layer 8.

The bonding layer 4, the anti-oxidizing layer 5, heat-insulating layer 6 and the refractory layer 7 were formed in the same manner as in Example 6. After that, an aluminum phosphate solution (concentration 40%) was applied to the dried surface of the refractory layer 7, heated to 110° C. at a heating rate of 10° C./min, kept at 110° C. for 1 hour and cooled to room temperature to form a surface layer 8 of 8 μm in thickness.

EXAMPLE 8

Figure 9:
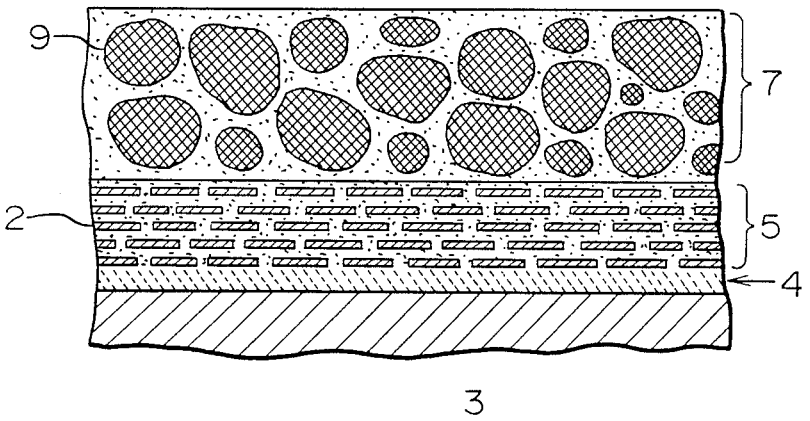

FIG. 9 is a cross-sectional view schematically showing a ceramic coating consisting of a bonding layer 4 formed on the inner surface of the metal tubular member 3, an anti-oxidizing layer 5 and a refractory layer 7.

The bonding layer 4 and the anti-oxidizing layer 5 were formed in the same manner as in Example 2. After that, refractory material powder (alumina having a particle size of 44–150 μm), sodium silicate (a silicate binder) and burned aluminum phosphate (a hardener)

were mixed in the following ratio to form a mixture slurry.

Sodium silicate ($SiO_2/Na_2O$ molar ratio 3.0, concentration 30 weight %)
100 parts by weight
Alumina (<74 μm)
85 parts by weight
Burned aluminum phosphate (<74 μm)
10 parts by weight The above mixture slurry was applied to the dried surface of the anti-oxidizing layer 5 formed on the inner surface of the metal tubular member 3 and cured for 2 hours, and this cycle was repeated to form the refractory layer 7.

In this state, it was cured at room temperature for 15 hours to cause a hardening reaction of sodium silicate and burned aluminum phosphate to take place in the refractory layer 7.

Next, this metal tubular member 3 was heated from room temperature to 300° C. at a heating rate of 1° C./min in a drying device, kept at 300° C. for 1 hour and cooled to room temperature to remove excess water.

Next, this metal tubular member 3 was heated to 800° C. at a heating rate of 200° C./hr in an $N_2$ atmosphere (oxygen partial pressure: 5 mmHg), kept at 800° C. for 1 hour and then cooled to room temperature, thereby hardening the refractory layer 7 of 1000 μm in thickness.

EXAMPLE 9

Figure 10:
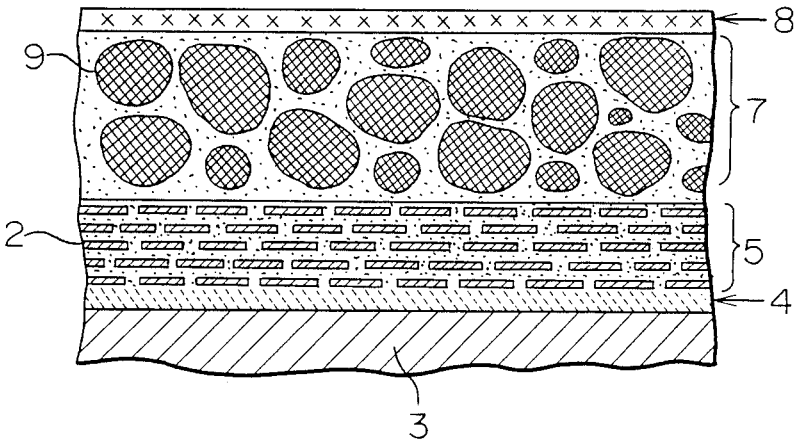

FIG. 10 is a cross-sectional view schematically showing a ceramic coating consisting of a bonding layer 4 formed on the inner surface of the metal tubular member 3, an anti-oxidizing layer 5, a refractory layer 7 and a surface layer 8.

The bonding layer 4, the anti-oxidizing layer 5 and the refractory layer 7 were formed in the same manner as in Example 8. After that, an alumina sol (concentration 10 weight %) was applied to the dried surface of the refractory layer 7, heated to 110° C. at a heating rate of 10° C./min, kept at 110° C. for 1 hour and then cooled to room temperature to form the surface layer 8 of 8 μm in thickness.

EXAMPLE 10

FIG. 11 is a cross-sectional view schematically showing a ceramic coating consisting of a bonding layer 4, an anti-oxidizing layer 5 and a heat-insulating layer 6.

The bonding layer 4 and the anti-oxidizing layer 5 were formed in the same manner as in Example 4. Next, this metal tubular member 3 was heated from room temperature to 300° C. at a heating rate of 1° C./min in a drying device, kept at 300° C. for 1 hour to remove excess water.

Next, ceramic microballoons having a bulk density of 0.47 and a particle size of 44–150 μm (heat-insulating material powder), crushed silica balloons (inorganic flaky particles), sodium silicate (a silicate binder) and burned aluminum phosphate (a hardener) were mixed in the following ratio to form a mixture slurry.

Sodium silicate ($SiO_2/Na_2O$ molar ratio 3.0, concentration 30 weight %)
100 parts by weight
Ceramic balloon (<100 μm)
20 parts by weight
Crushed silica balloon (<74 μm)
25 parts by weight
Burned aluminum phosphate (<74 μm)
10 parts by weight The above mixture slurry was applied to the dried surface of the anti-oxidizing layer 5 formed on the inner surface of the metal tubular member 3 and cured for 2 hours, and this cycle was repeated to form a heat-insulating layer 6.

In this state, it was cured at room temperature for 15 hours to cause a hardening reaction of sodium silicate and burned aluminum phosphate in the heat-insulating layer.

Next, this metal tubular member 3 was placed in a drying device to remove excess water. The metal tubular member 3 was then heated from room temperature to 300° C. at a heating rate of 1° C./min, kept at 300° C. for 1 hour and then cooled to room temperature.

Next, this metal tubular member 3 was heated to 800° C. at a heating rate of 200° C./hr in an $N_2$ atmosphere (oxygen partial pressure: 5 mmHg), kept at 800° C. for 1 hour and then cooled to room temperature, thereby hardening the heat-insulating layer 6 of 1500 μm in thickness.

The structure and thickness of each ceramic coating in Examples 2–10 are shown in Table 2.

TABLE 2

| | Thickness of Each Coating Layer (μm) | | | | | |
|---|---|---|---|---|---|---|
| Example No. | Bonding Layer | Anti-Oxidizing Layer | Heat-Insulating Layer | Refractory Layer | Surface Layer | Total |
| 2 | 30 | 300 | — | — | — | 330 |
| 3 | 30 | 300 | — | — | 8 | 338 |
| 4 | 30 | 300 | 1500 | — | — | 1830 |
| 5 | 30 | 300 | 1500 | — | 8 | 1838 |
| 6 | 30 | 300 | 1500 | 1000 | — | 2830 |
| 7 | 30 | 300 | 1500 | 1000 | 8 | 2838 |
| 8 | 30 | 300 | — | 1000 | — | 1330 |
| 9 | 30 | 300 | — | 1000 | 8 | 1338 |
| 10 | 30 | 300 | 1500 | — | — | 1830 |

In order to evaluate the properties of the ceramic coatings in the above Examples 2–10, the following heating tests were conducted.

(1) Test Conditions

Each coated tubular member 3 was attached to a heating apparatus which generated a high-temperature gas by burning propane gas, and the inner surface of the coated tubular member 3 was heated under the conditions shown in Table 3.

TABLE 3

| | |
|---|---|
| Gas temperature | 1000° C. |
| Primary air flow | 50 $Nm^3/hr$ |
| Propane gas flow | 2 $Nm^3/hr$ |
| Secondary air flow | 36 $Nm^3/hr$ |
| Oxygen concentration | 11% |
| Heating rate | 1000° C./min |

(2) Corrosion Test

The thickness of an oxide layer formed by heating by a combustion gas under the conditions shown in Table 3 was measured at each time by a scanning electron microscope (SEM) . The results are shown in Table 4 together with Comparative Example 1 for the uncoated tubular member.

The anti-oxidizing effects in Examples 2 and 3 were about 4 times as large as in Comparative Example 1 and those in Examples 4 and 5 were about 30 times as large as in Comparative Example 1.

TABLE 4

| | Thickness of Oxide Layer (μm) after | | | | |
|---|---|---|---|---|---|
| No. | 10 hr. | 25 hr. | 40 hr. | 54 hr. | 70 hr. |
| 2 | 0.20 | 0.32 | 0.40 | 0.46 | 0.53 |
| 3 | 0.10 | 0.30 | 0.40 | 0.45 | 0.50 |
| 4 | 0.02 | 0.03 | 0.05 | 0.06 | 0.07 |
| 5 | 0.01 | 0.03 | 0.04 | 0.06 | 0.07 |
| 6 | 0.00 | 0.00 | 0.00 | 0.00 | 0.00 |
| 7 | 0.00 | 0.00 | 0.00 | 0.00 | 0.00 |
| 8 | 0.13 | 0.21 | 0.27 | 0.31 | 0.36 |
| 9 | 0.10 | 0.19 | 0.27 | 0.31 | 0.35 |
| 10 | 0.05 | 0.09 | 0.13 | 0.14 | 0.17 |
| 1* | 0.85 | 1.37 | 1.74 | 2.02 | 2.3 |

Note
*Comparative Example (3) Heat Insulation Test

The surface temperature of each coated metal tubular member heated under the conditions shown in Table 3 was measured to evaluate the heat insulation of each ceramic coating. The results are shown in Table 5 together with those of Comparative Example 1.

TABLE 5

| | Temperature of Metal Member (°C.) | |
|---|---|---|
| No. | Inner Surface | Outer Surface |
| 2 | 685 | 650 |
| 3 | 690 | 650 |
| 4 | 800 | 530 |
| 5 | 810 | 535 |
| 6 | 825 | 490 |
| 7 | 840 | 480 |
| 8 | 710 | 620 |
| 9 | 715 | 620 |
| 10 | 755 | 575 |
| 1* | 670 | 665 |

Note
*Comparative Example (4) Durability Test

Each coated tubular member was heated for 30 minutes under the conditions shown in Table 3 and then cooled to room temperature, and this heating and cooling cycle was repeated 100 times. As a result, none of the ceramic coatings suffered from cracking, peeling, etc., confirming that it had sufficient durability.

The function and effects of each layer in the above Examples will be explained.

On the inner surface of the metal tubular member 3, the bonding layer 4 having a thickness of about 30 μm was formed. This bonding layer 4, which was in a dense, glassy state, had good adhesion to cast iron. Thus, it contributed to the bonding of the anti-oxidizing layer 5 to the cast iron member.

The anti-oxidizing layer 5 formed on the surface of this bonding layer 4 had a thickness of about 300 μm. The anti-oxidizing layer 5 was bonded strongly to the metal tubular member 3 via the bonding layer 4. Since the anti-oxidizing layer 5 has a structure in which flaky particles having a thickness of 0.5–2 μm and a longer diameter of 5–20 μm were laminated in a cross-linked manner, it was sufficiently flexible. It was confirmed by the evaluation tests that the anti-oxidizing layer did not suffer from cracking and peeling even after being subjected to expansion and shrinkage due to repeated heating and cooling.

The heat-insulating layer 6 had a thickness of 1500 μm. Incidentally, since the heat-insulating layer in Example 10 contained ceramic hollow particles dispersed in a matrix consisting of a mixture of inorganic flaky particles, a binder and a hardener, the heat-insulating layer was bonded strongly to the anti-oxidizing layer and had sufficient resistance to rapid heat shock and excellent heat insulation.

The refractory layer 7 was composed of a refractory material sufficiently durable to high-temperature exhaust gas exceeding 1000° C. and it was strongly bonded to the heat-insulating layer 6.

Further, the surface layer 8 had a thickness of 8 μm. This surface layer 8 was a thin, dense layer, covering the pores of the heat-insulating layer 6 or the refractory layer 7 and also preventing the penetration of harmful gases to the anti-oxidizing layer 5.

As described above in detail, since the ceramic coating bonded to a metal member according to the present invention comprises the bonding layer serving to strengthen the bonding of the ceramic coating to the metal member and the anti-oxidizing layer having a structure in which inorganic flaky particles are laminated in a cross-linked manner, it is not likely to peel off or be cracked under heated conditions and also has extremely good corrosion resistance. Therefore, when the ceramic coating of the present invention is used in exhaust equipment of internal combustion engines, etc., it can sufficiently endure repeated heat shock generated by an exhaust gas exceeding 800° C. In addition, it can impart excellent corrosion resistance, heat insulation and heat resistance to the exhaust equipment, increasing its service life. The ceramic coating having such advantages can be used in manifolds for exhaust gas of engines, and other various members such as exhaust pipes, port liners, front tubes, turbo chargers, etc.

What is claimed is:

1. A ceramic coating bonded to a metal member comprising a bonding layer having a thickness of less than about 50 μm and formed by the reaction of an oxide layer formed on a surface of said metal member in advance and a silicate; and an anti-oxidizing first ceramic layer having a thickness of about 150–1000 μm and formed on said bonding layer and comprising about 30–60% by weight of inorganic flaky particles having a long diameter and short diameter each within about 2–74 μm and a long diameter/thickness ratio of about 10 or more, said particles being burned to have a cross-linked laminate structure.

2. The ceramic coating bonded to a metal member according to claim 1, wherein said inorganic flaky particles are selected from the group consisting of natural mica, artificial mica, thin glass and inorganic hollow particles.

3. The ceramic coating bonded to a metal member according to claim 1, further comprising a thin, dense surface layer having a thickness of less than about 15 μm and composed of an inorganic binder and/or an organometallic binder on said first ceramic layer.

4. The ceramic coating bonded to a metal member according to claim 1, further comprising a heat-insulating second layer having thickness of about 200–2000

μm, said second layer containing inorganic hollow particles having an average particle size of about 10–500 μm and formed by burning a heat-insulating material mainly composed of inorganic hollow particles on a surface of said first ceramic layer.

5. The ceramic coating bonded to a metal member according to claim 4, further comprising a thin, dense surface layer having a thickness of less than about 15 μm and composed of an inorganic binder and/or an organometallic binder on said second ceramic layer.

6. The ceramic coating bonded to a metal member according to claim 4, further comprising a refractory third ceramic layer having a thickness of about 100–2000 μm and formed by burning a refractory material mainly composed of inorganic particles having an average particle size of about 10–500 μm, on a surface of said second ceramic layer.

7. The ceramic coating bonded to a metal member according to claim 6, further comprising a thin, dense surface layer having a thickness of less than about 15 μm and composed of an inorganic binder and/or an organometallic binder on said third ceramic layer.

8. The ceramic coating bonded to a metal member according to claim 1, further comprising a refractory third ceramic layer having a thickness of about 100–2000 μm and formed by burning a refractory material mainly composed of inorganic particles having an average particle size of about 10–500 μm, on a surface of said first ceramic layer.

9. The ceramic coating bonded to a metal member according to claim 8, further comprising a thin, dense surface layer having a thickness of less than about 15 μm and composed of an inorganic binder and/or an organometallic binder on a surface of said third ceramic layer.

10. The ceramic coating bonded to a metal member according to claim 1, wherein said metal member is an exhaust equipment member.

11. The ceramic coating bonded to a metal member according to any of claims 1–9, wherein said bonding layer has a thickness of 50 μm or less; said first ceramic layer has a thickness of 150–1000 μm and comprising 30–60% by weight of inorganic flaky particles having a long diameter and short diameter each within 2–74 μm and long diameter/thickness ratio of 10 or more; and further comprising a second ceramic layer having a thickness of 200–2000 μm containing inorganic hollow particles having an average particle size of 10–500 μm; a third ceramic layer having a thickness of 100–200 μm and composed of inorganic particles having an average particle size of 10–500 μm; and a surface layer having a thickness of 15 μm or less.

* * * * *

UNITED STATES PATENT AND TRADEMARK OFFICE

CERTIFICATE OF CORRECTION

PATENT NO. : 4,975,314

DATED : December 4, 1990

INVENTOR(S) : Mitsuru Yano et al.

It is certified that error appears in the above-identified patent and that said Letters Patent is hereby corrected as shown below:

In the Abstract:

Change "silicated" to --silicate-- on line 4.

Signed and Sealed this

Twenty-second Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,975,314

DATED : December 4, 1990

INVENTOR(S) : Mitsuru Yano, et al.

It is certified that error appears in the above-identified patent and that said Letters Patent is hereby corrected as shown below:

Title page, item (73):

Please add second assignee

--Kurosaki Refractories Co., Ltd.
1-1, Higashihama, Yahatanishi-ku
Kitakyushu-shi, Fukuoka, Japan--

Signed and Sealed this

Ninth Day of February, 1993

*Attest:*

STEPHEN G. KUNIN

*Attesting Officer*

*Acting Commissioner of Patents and Trademarks*